US006527157B1

(12) United States Patent
Choi

(10) Patent No.: US 6,527,157 B1
(45) Date of Patent: Mar. 4, 2003

(54) STAPLER WITH PUNCHING UNIT

(76) Inventor: Tae-Jung Choi, 726-7, Joong-dong, Wonmi-gu, Puchon-shi, Gyunggi-do (KR)

( * ) Notice: Subject to any disclaimer, the term of this patent is extended or adjusted under 35 U.S.C. 154(b) by 0 days.

(21) Appl. No.: 09/647,162

(22) PCT Filed: Oct. 1, 1999

(86) PCT No.: PCT/KR99/00597

§ 371 (c)(1),
(2), (4) Date: Sep. 27, 2000

(87) PCT Pub. No.: WO00/20176

PCT Pub. Date: Apr. 13, 2000

(30) Foreign Application Priority Data

Oct. 2, 1998 (KR) ..... 98-19023
Mar. 24, 1999 (KR) ..... 99-9723

(51) Int. Cl.[7] ..... B27F 7/00
(52) U.S. Cl. ..... 227/76; 227/134; 227/64
(58) Field of Search ..... 227/76, 134, 64

(56) References Cited

U.S. PATENT DOCUMENTS 2,227,314 A * 12/1940 Maynard ..... 227/120
4,002,281 A * 1/1977 Hsu ..... 227/63
4,114,793 A * 9/1978 Hsu ..... 227/63
4,240,572 A * 12/1980 Mitsuhashi ..... 227/76
4,288,018 A * 9/1981 Taniguchi ..... 227/76
4,497,261 A * 2/1985 Ferris et al. ..... 109/2
4,727,610 A * 3/1988 Lin ..... 227/156
4,779,785 A * 10/1988 Amagaya ..... 227/76
5,184,765 A * 2/1993 Orozco ..... 227/27
5,762,329 A * 6/1998 Nakazato et al. ..... 270/58.09
5,979,734 A * 11/1999 Chang ..... 227/134

* cited by examiner

*Primary Examiner*—Rinaldi I. Rada
*Assistant Examiner*—Louis Tran
(74) *Attorney, Agent, or Firm*—Staas & Halsey LLP

(57) ABSTRACT

A stapler, having a collateral punching function in addition to an original stapling function and being selectively used as a stapler or a punch as desired, is disclosed. In the stapler, a longitudinal base has a staple forming die at its front end portion and two parallel support walls at its rear end portion. A punch hole is formed on the top surface of the base at a position between the two support walls, while a sheet insert slit is formed between the two support walls and the top surface of the base so as to allow sheets of paper to be inserted into the slit during a punching operation. A pressing lever is hinged to the shaft holes of the support walls and its bearing holes using a lever shaft and is manually operated by a user so as to perform a desired stapling operation or a desired punching operation. A staple feeder is hinged to the first shaft holes of the lever. A punching plunger, having a cutting edge at its lower end, is vertically positioned on the base at a position between the two support walls while being normally biased by a spring upwardly. The plunger thus comes into contact with the lower surface of the lever at its top end and is vertically inserted into the punch hole at its lower end portion during a punching operation.

6 Claims, 17 Drawing Sheets

STAPLER WITH PUNCHING UNIT

TECHNICAL FIELD

The present invention relates, in general, to a stapler, or a device used to fasten sheets of paper together, and, more particularly, to a stapler, designed to have a collateral punching function in addition to an original stapling function, thus being selectively used as a stapler or a punch as desired.

BACKGROUND ART

This invention is applied under priority claim based on Korean U.M. Application Nos. 97-4,723 and 98-1,9023.

As well known to those skilled in the art, a stapler is a device used to fasten sheets of paper together using staples, while a punch is a device used to cut holes in sheets of paper by pushing a piece of metal through the sheets prior to fastening the sheets of paper together using a fastener. Both such stapler and punch are generally and widely used in offices.

However, the conventional staplers and the conventional punches are separate devices, thus forcing users to separately purchase them while forcing excessive costs on the users. Such separate staplers and punches are also inconvenient to the users while keeping or using them.

DISCLOSURE OF THE INVENTION

Accordingly, the present invention has been made keeping in mind the above problems occurring in the prior art, and an object of the present invention is to provide a stapler, which is designed to have a collateral punching function in addition to an original stapling function and to be selectively used as a stapler or a punch as desired, and which thus allows a user to purchase a punch-integrated stapler without forcing excessive costs on the user and is convenient to the user while keeping and using it.

In order to accomplish the above object, the present invention provides a stapler with a punching unit, comprising a longitudinal base having a staple forming die at its front end portion and two parallel support walls at its rear end portion, with both a punch hole being formed on a top surface of the base at a position between the two support walls and a sheet insert slit being formed between the two support walls and the top surface of the base so as to allow sheets of paper to be inserted into the slit during a punching operation; a pressing lever hinged to shaft holes of the support walls at its bearing holes using a lever shaft and manually operated by a user so as to perform a desired stapling operation or a desired punching operation; a staple feeder hinged to first shaft holes of the lever and used for receiving staples therein; and a punching plunger having a cutting edge at its lower end, the punching plunger being vertically positioned on the base at a position between the two support walls while being normally biased by a spring upwardly, thus coming into contact with the lower surface of the lever at its top end and being vertically inserted into the punch hole at its lower end portion.

BRIEF DESCRIPTION OF THE DRAWINGS

The above and other objects, features and other advantages of the present invention will be more clearly understood from the following detailed description taken in conjunction with the accompanying drawings, in which:

FIGS. 1 to 5 are views, showing a stapler with a punching unit in accordance with the primary embodiment of the present invention, in which:

FIG. 1 is an exploded perspective view of the stapler;

FIG. 2 is a longitudinal sectioned view of the stapler, showing an operation of the stapler when it is used as a stapler;

FIG. 3 is a cross-sectioned view of the stapler taken along the line A—A of FIG. 2;

FIG. 4 is a longitudinal sectioned view of the stapler, showing an operation of the stapler when it is used as a punch; and FIG. 5 is a side view of a stapler, with the sheet insert slit of a punching unit being opened toward the stapling unit in accordance with a modification of the primary embodiment;

FIGS. 6 and 7 are views, showing a stapler with a punching unit in accordance with the second embodiment of the present invention, in which:

FIG. 6 is an exploded perspective view of the stapler; and

FIG. 7 is a side view of the stapler, showing an operation of the stapler when it is used as a punch;

FIGS. 8 to 10 are views, showing a stapler with a punching unit in accordance with the third embodiment of the present invention, in which:

FIG. 8 is an exploded perspective view of the stapler;

FIG. 9 is a longitudinal sectioned view of the stapler, showing an operation of the stapler when it is used as a stapler; and FIG. 10 is a longitudinal sectioned view of the stapler, showing an operation of the stapler when it is used as a punch;

FIGS. 12 to 14 are views, showing a stapler with a punching unit in accordance with the fifth embodiment of the present invention, in which:

FIG. 12 is an exploded perspective view of the stapler;

FIG. 13 is a longitudinal sectioned view of the stapler, showing an operation of the stapler when it is used as a stapler; and FIG. 14 is a longitudinal sectioned view of the stapler, showing an operation of the stapler when it is used as a punch; and FIGS. 15 to 17 are views, showing a stapler with a punching unit in accordance with the sixth embodiment of the present invention, in which:

FIG. 15 is an exploded perspective view of the stapler;

FIG. 16 is a longitudinal sectioned view of the stapler, showing an operation of the stapler when it is used as a stapler; and FIG. 17 is a longitudinal sectioned view of the stapler, showing an operation of the stapler when it is used as a punch.

BEST MODE FOR CARRYING OUT THE INVENTION

Figure 1:
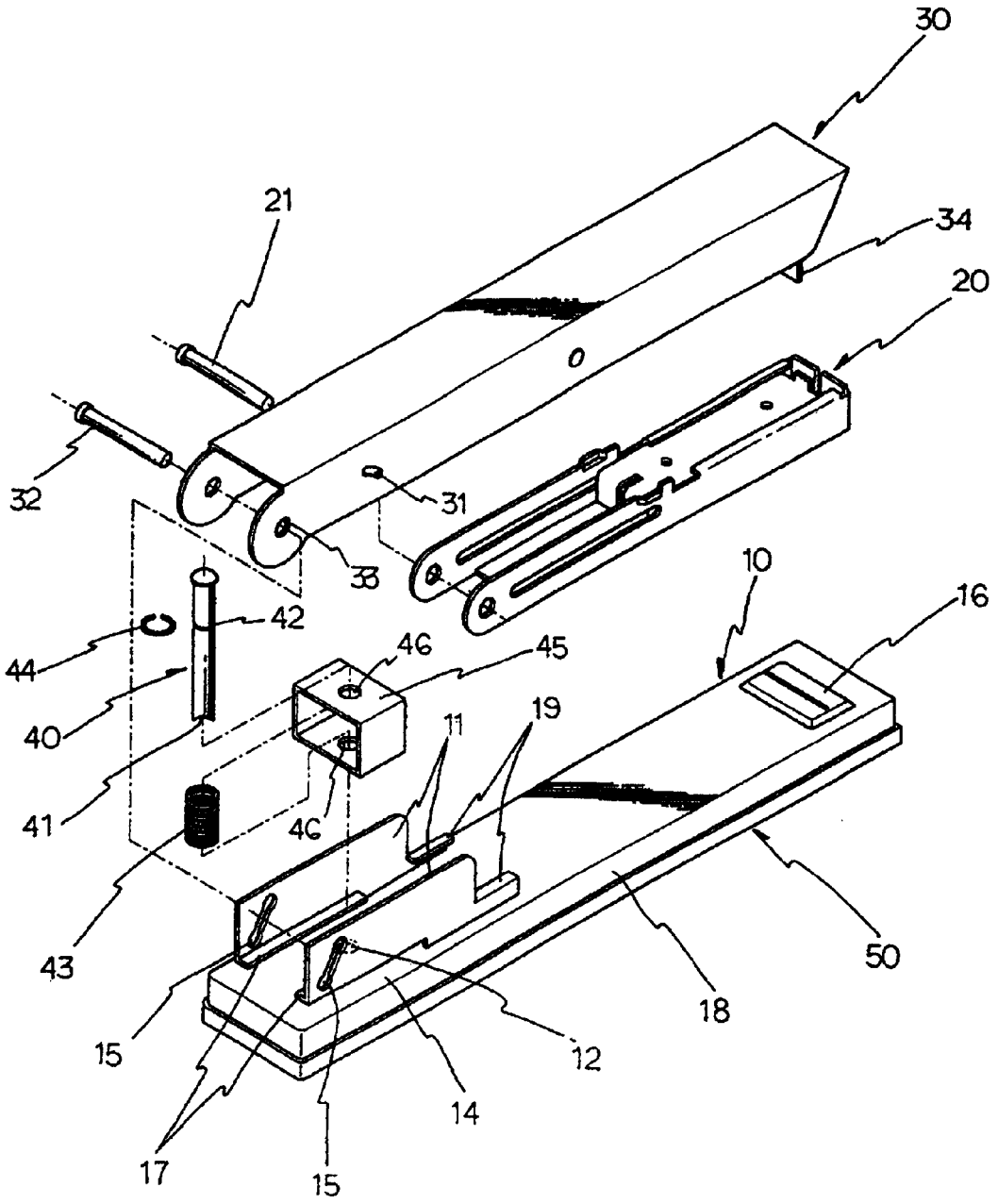
Figure 2:
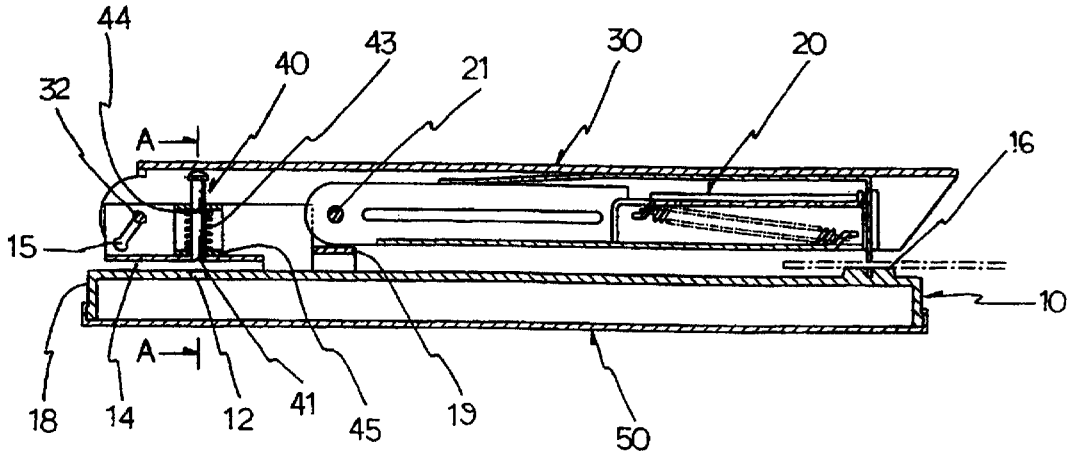
Figure 3:
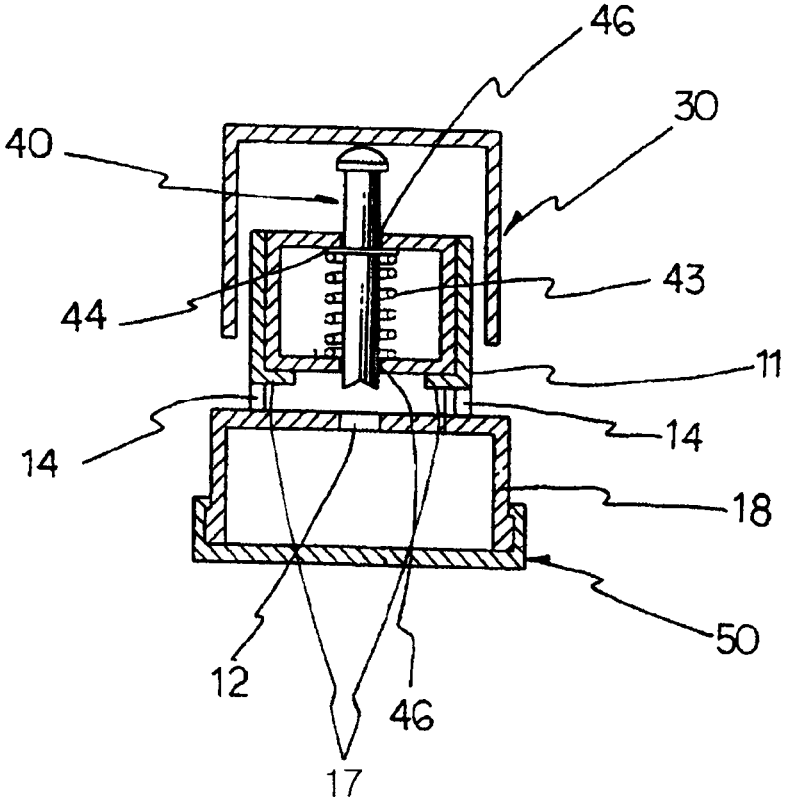
Figure 4:
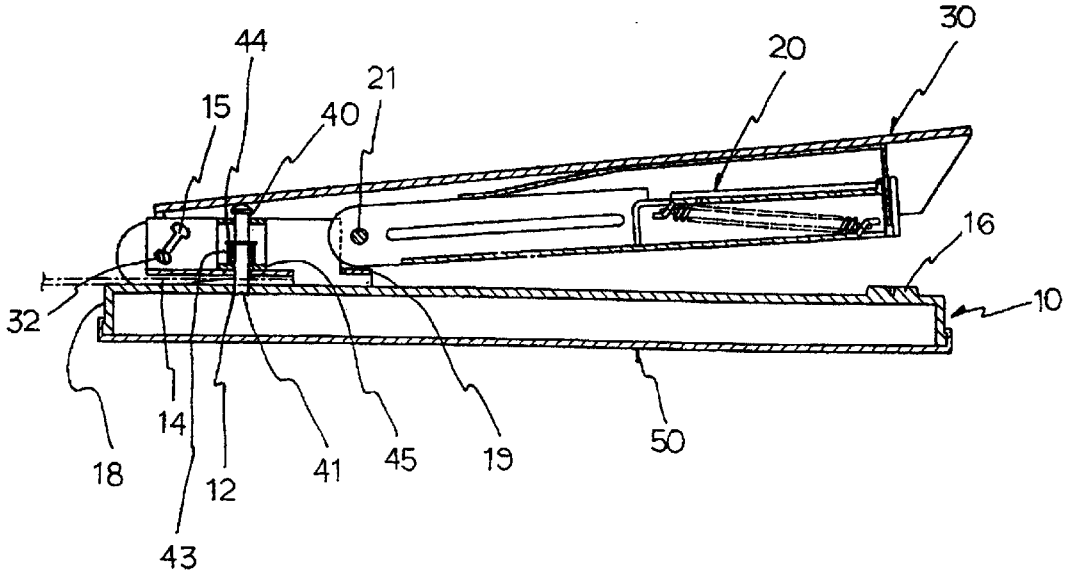
Figure 5:
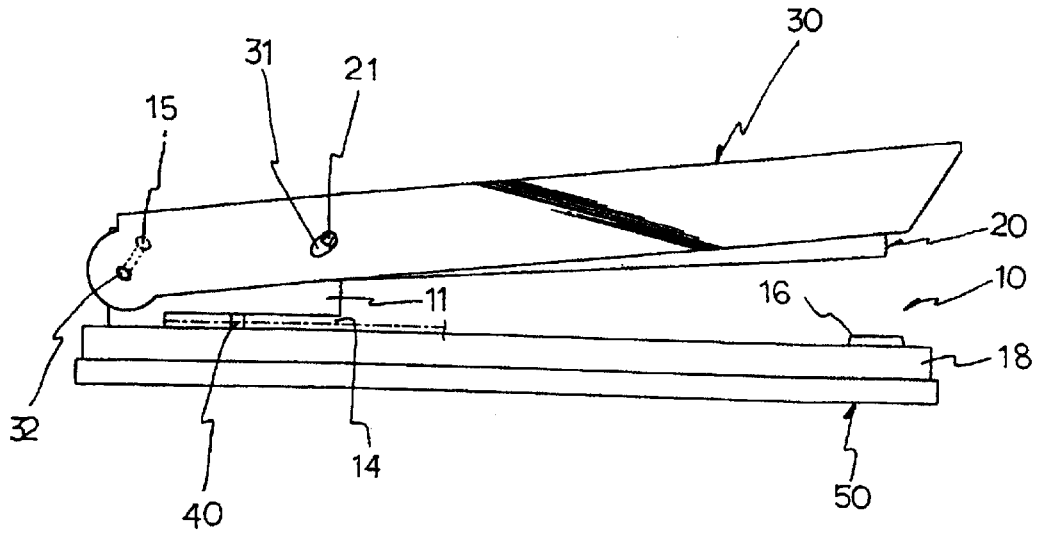

FIGS. 1 to 5 are views, showing a stapler with a punching unit in accordance with the primary embodiment of the present invention. That is, FIG. 1 is an exploded perspective view of the stapler. FIG. 2 is a longitudinal sectioned view, showing an operation of the stapler when it is used as a stapler. FIG. 3 is a cross-sectioned view of the stapler taken along the line A—A of FIG. 2. FIG. 4 is a longitudinal sectioned view, showing an operation of the stapler when it is used as a punch. FIG. 5 is a side view of a stapler, with the sheet insert slit of a punching unit being opened toward the stapling unit in accordance with a modification of the primary embodiment.

Figure 6:
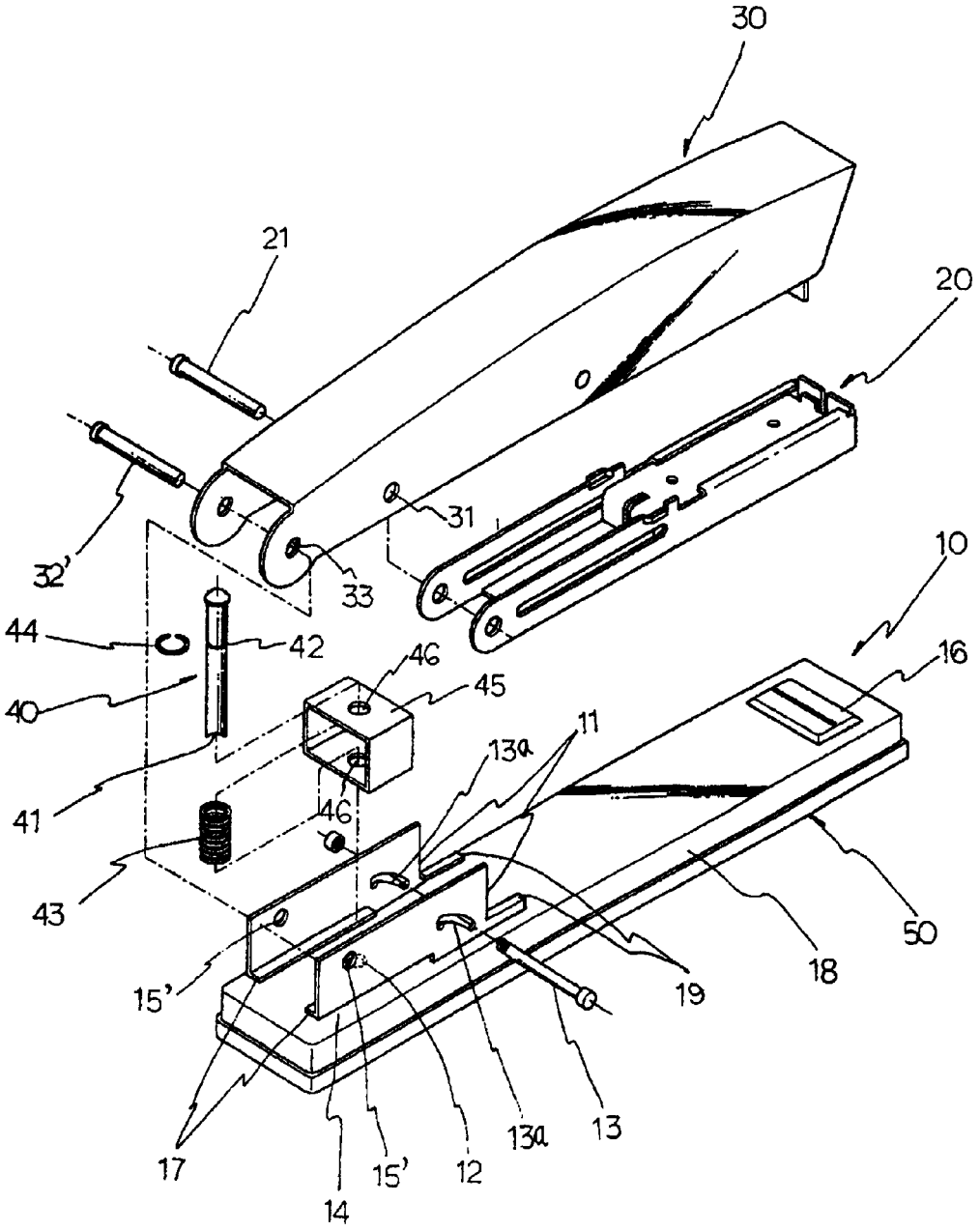
Figure 7:
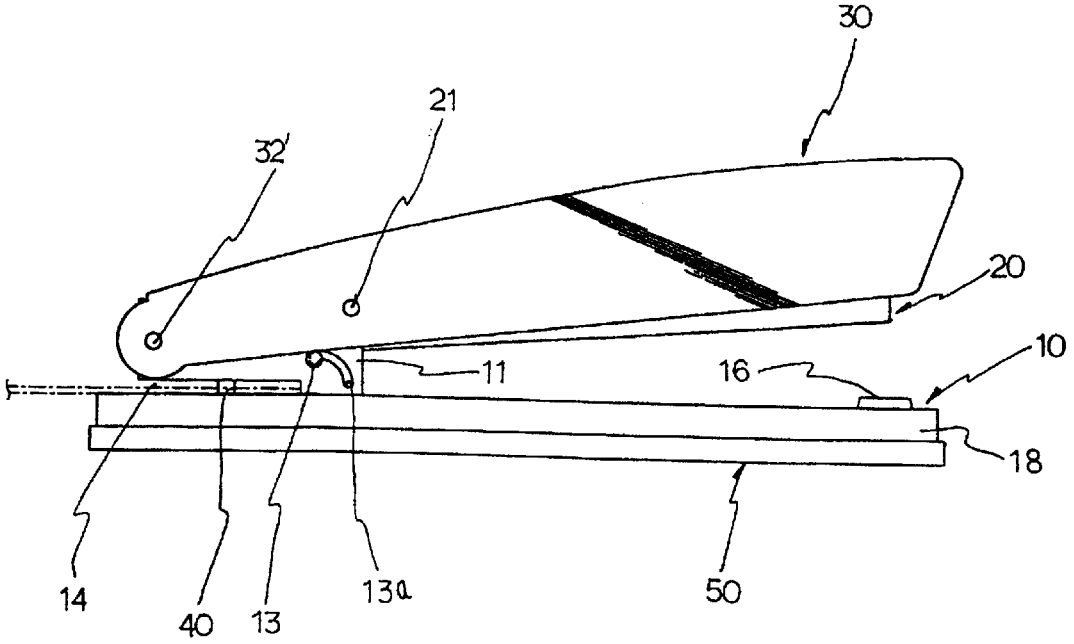

FIG. 6 is an exploded perspective view of a stapler with a punching unit in accordance with the second embodiment of the present invention. FIG. 7 is a side view of the stapler of FIG. 6, showing an operation of the stapler when it is used as a punch.

Figure 8:
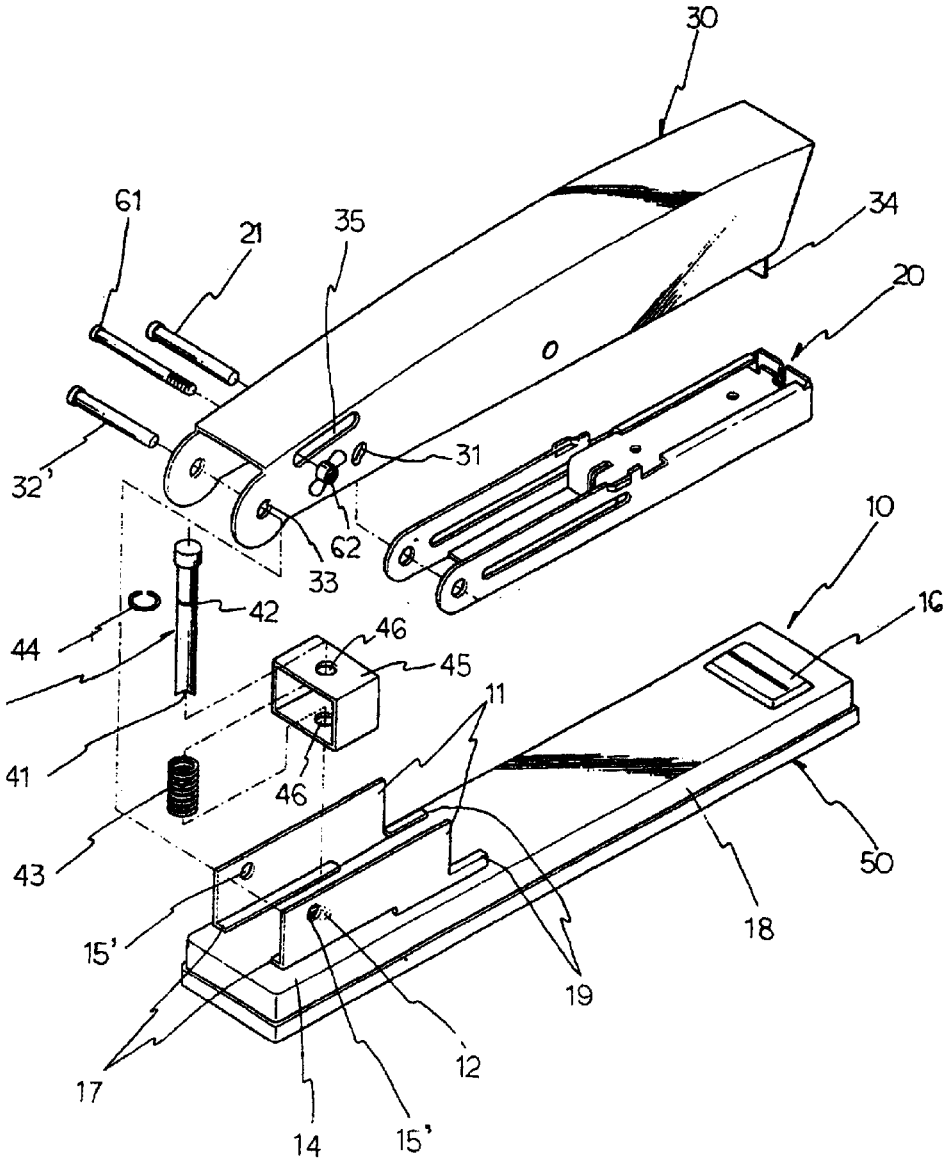
Figure 9:
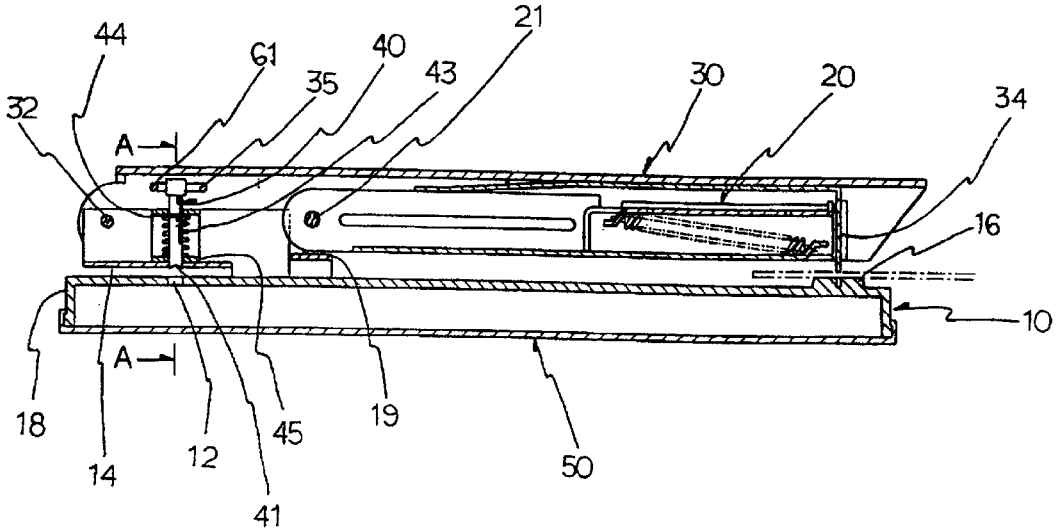
Figure 10:
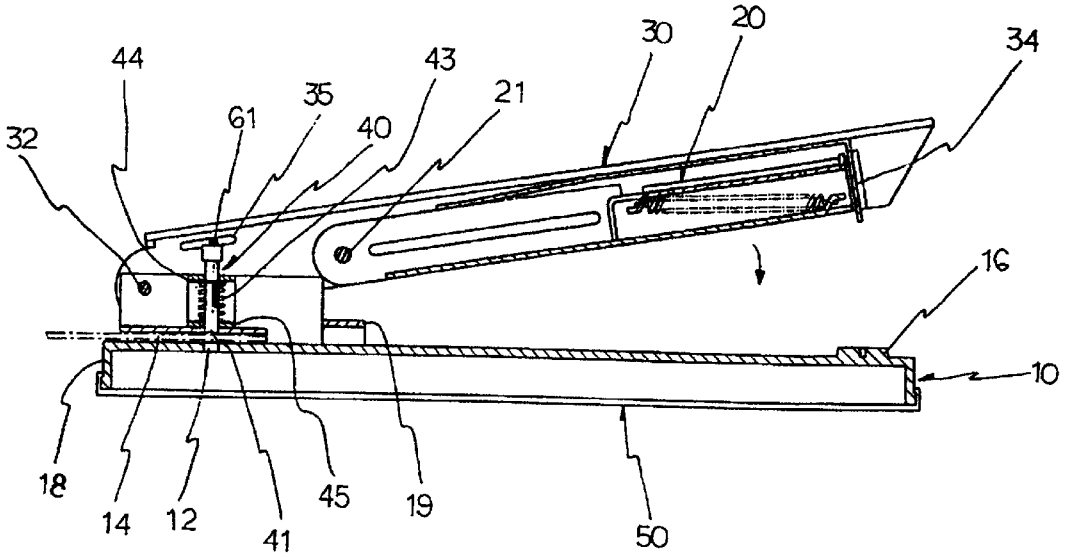

FIG. 8 is an exploded perspective view of a stapler with a punching unit in accordance with the third embodiment of the present invention. FIG. 9 is a longitudinal sectioned view of the stapler of FIG. 8, showing an operation of the stapler when it is used as a stapler. FIG. 10 is a longitudinal sectioned view of the stapler of FIG. 8, showing an operation of the stapler when it is used as a punch.

Figure 11:
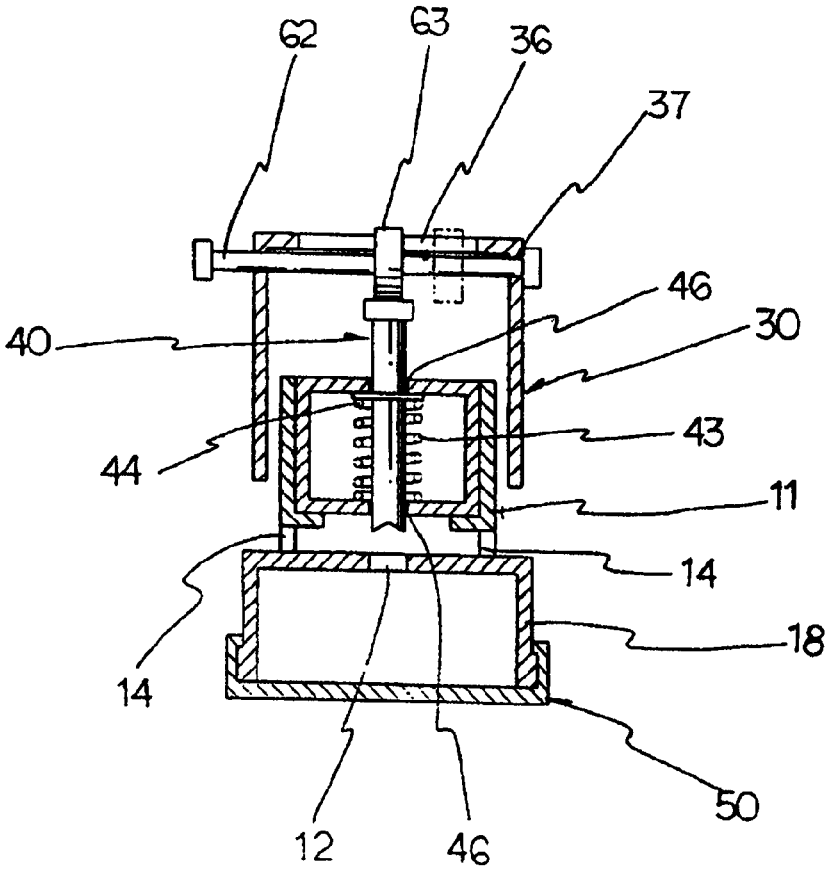
FIG. 11 is a cross-sectioned view of a stapler with a punching unit in accordance with the fourth embodiment of the present invention.

FIG. 11 is a cross-sectioned view of a stapler with a punching unit in accordance with the fourth embodiment of the present invention.

Regardless of the embodiments, the stapler of this invention basically comprises a base 10, a staple feeder 20 and a pressing lever 30 in the same manner as a conventional stapler. The stapler of this invention also has a punching plunger 40 and a cut piece container cover 50, thus being selectively used as a punch when necessary. In the stapler of this invention, it is preferable to make the parts except for the plastic container cover 50 using a metal.

The stapler according to the primary embodiment will be described herein below with reference to FIGS. 1 to 5.

As shown in FIG. 1, two upright support walls 11 are longitudinally and parallelly positioned along both side edges of the top surface of the base 10 at the rear portion in the same manner as a conventional stapler. The top edge of the front portion of each support wall 11 is inwardly bent at right angles, thus forming locking flanges 19. The two locking flanges 19 selectively catch both lower ends of the rear portion of the staple feeder 20 when the lever 30 is primarily pressed down with the front end of the feeder 20 being close to the staple die 16 just before both sharpened ends of a staple are pushed into sheets of paper.

Of course, it should be understood that it may be possible to form such locking flanges 19 by partially deforming the base 10 or the bracket 45 or by integrating separate metal pieces with the base 10 at appropriate positions without affecting the functioning of the locking flanges 19.

A second shaft hole 15 is formed on the rear portion of each support wall 11 and holds each end of a lever shaft 32. The lever 30 is rotatably held on the lever shaft 32 at two bearing holes 33. The two bearing holes 33 are formed on both sidewalls of the lever 30 at the rear portion. The above lever shaft 32 has an oval cross-section, and the bearing holes 33 of the lever 30 have an oval-shaped profile corresponding to the cross-section of the shaft 32. The second shaft hole 15 comprises two oval holes, which are formed at different positions with different heights and communicate with each other through a channel. Each of the oval holes of the second shaft hole 15 is designed to have a major diameter corresponding to the major diameter of the oval lever shaft 32, while the channel extending between the two oval holes of the shaft hole 15 is designed to have a width corresponding to the minor diameter of the oval lever shaft 32. Therefore, the lever shaft 32 may be moved along the channel so as to reach one of the two oval holes when a user moves the lever 30, but the lever shaft 32 is prevented from being unexpectedly moved between the two oval holes during a normal operation of the lever 30.

A first shaft hole 31 is formed on each sidewall of the lever 30 at a position in front of the bearing holes 33. The first shaft holes 31 are used for hinging the rear end of the staple feeder 20 to the sidewalls of the lever 30 using a feeder shaft 21.

The above first shaft holes 31 have an arc-shaped profile suitable for absorbing a variable projected length of the staple feeder 20 when the lever 30 is secondarily pressed down to push the ends of a staple into sheets of paper after the feeder 20 is caught by the locking flanges 19.

A circular punch hole 12 is formed on the top surface of the base 10 at an intermediate position between the first and second shaft holes 31 and 15. The above punch hole 12 preferably has a diameter slightly larger than the outer diameter of the punching plunger 40 as will be described later herein.

A sheet insert slit 14 is formed between the top surface of the base 10 and the two support walls 11. In the primary embodiment of FIGS. 1 to 4, the sheet insert slit 14 is opened toward the rear end of the stapler, thus allowing sheets of paper to be inserted forwardly from the rear end of the stapler. However, in a modification of the primary embodiment, the sheet insert slit 14 is designed to be open toward the front end of the stapler, thus allowing sheets of paper to be inserted backwardly from the front portion of the stapler as shown in FIG. 5. The objective of the above slit 14 is to allow sheets of paper to reach a position above the punch hole 12, and so it is necessary to make the web of the slit 14 positioned over the punch hole 12.

The above punching plunger 40 is a conventional punching plunger with an arc-shaped edge 41 being formed at the lower end of the plunger. An annular groove 42 is formed around the external surface of the punching plunger 40, thus allowing a stop ring 44 to be fitted over the plunger 40. A coil spring 43 is fitted over the lower portion of the punching plunger 40 and is stopped by the ring 44 at its top end.

In the present invention, a box-shaped bracket 45, having a plunger hole 46 at each of its top and bottom walls, is fixedly positioned between the two support walls 11 on the base 10 at a position around the punch hole 12 and movably receives the punching plunger 40 at the plunger holes 46, thus forming a punching unit. In order to assemble the punching unit, the punching plunger 40 is set in the bracket 45 while passing through the two plunger holes 46 with the coil spring 43 being fitted over the plunger 40 within the bracket 45 as shown in FIG. 3. Thereafter, the stop ring 44 is fitted over the annular groove 42 of the plunger 40, thus stopping the top end of the spring 43. In such a case, the spring 43, of which the lower end is stopped by the bottom wall of the bracket 45, is a compression coil spring, and so the spring 43 normally biases the punching plunger 40 upwardly. The top end of the punching plunger 40 thus always comes into close contact with the lower surface of the rear end portion of the lever 30. After the punching plunger 40 is completely assembled with the bracket 45, the bracket 45 is fixedly mounted between the two support walls 11, with the lower end of the plunger 40 being precisely aligned with the punch hole 12. In order to stably mount the bracket 45 between the two support walls 11, the two support walls 11 are bent inwardly at right angles at their lower ends, thus forming support flanges 17 as shown in FIG. 3. When the bracket 45 is mounted between the two support walls 11, it is preferable to seat the bottom wall of the bracket 45 on the support flanges 17 and to weld the top portions of both sidewalls of the bracket 45 to the support walls 11.

The operational effect of the stapler according to the third embodiment will be described herein below.

The cut piece container cover 50 detachably covers the lower skirt 18 formed around of the base 10, thus forming a container for collecting cut pieces during a punching operation. The above cover 50 is thus designed to correspond to the profile of the skirt 18 and to easily and detachably cover the skirt 18 of the base 10.

The operational effect of the stapler according to the primary embodiment will be described herein below pressing lever 30 has to be primarily moved so as to make the lever shaft 32 positioned within the upper holes of the second shaft holes 15. In such a case, the lever 30 is biased upwardly by the spring-biased punching plunger 40, with the lower end of the plunger 40 being positioned above the sheet insert slit 14.

Thereafter, the lever 30, with the staple feeder 20, is primarily pressed down with sheets of paper being positioned on the die 16 of the base 10 in the same manner as a conventional stapler. When the lever 30 is primarily pressed down as described above, the two locking flanges 19 catch the lower ends of the rear portion of the staple feeder 20, with the front end of the feeder 20 being close to the staple die 16 just before both sharpened ends of a staple are pushed into sheets of paper. In such a case, the front end of the feeder 20 is precisely positioned above the die 16. When the lever 30 in the above state is further pressed down, the foremost staple contained in the staple feeder 20 is pushed into the sheets of paper by a pressing plate 34 of the lever 30. When the staple is pushed into the sheets of paper, the staple feeder 20, caught by the locking flanges 19, is prevented from being further rotated downwardly. In such a case, the projected length of the staple feeder 20 is increased as the lever 30 is pressed down to push the ends of the staple into the sheets of paper. However, the feeder shaft 21 moves backwardly along the arc-shaped first shaft holes 31 while absorbing the increased projected length of the feeder 20, thus allowing the stapling position to be precisely maintained.

When the lever 30 is pressed down as described above, the punching plunger 40 is moved downwardly while compressing the coil spring 43, thus passing through the punch hole 12 of the base 10. However, such a vertical movement of the plunger 40 does not disturb the stapling operation. When the pressing force is removed from the lever 30 after the stapling operation, the punching plunger 40 elastically pushes the lever 30 upwardly by the restoring force of the compression coil spring 43, thus returning both the lever 30 and the staple feeder 20 to their original positions.

When the stapler of this invention is used as a punch as shown in FIGS. 4 and 5, the pressing lever 30 has to be moved so as to make the lever shaft 32 positioned within the lower holes of the second shaft holes 15. In such a case, the lever 30 is biased upwardly by the spring-biased punching plunger 40, with the lower end of the plunger 40 being positioned above the sheet insert slit 14.

Thereafter, the lever 30, with the staple feeder 20, is fully pressed down with sheets of paper being inserted into the slit 14 formed at the front or rear portion of the support walls 11. When the lever 30 is pressed down as described above, the lower edge 41 of the punching plunger 40 is driven into the sheets of paper while compressing the coil spring 43 and passes through the punch hole 12 of the base 10, thus perforating the sheets of paper. Such a punching operation forms a plurality of cut pieces of paper, which are dropped into and collected within the container of the base 10 covered by the cover 50. During such a punching operation, the coil spring 43 is compressed as the lever 30 is pressed down. In such a case, the spring 43 is completely compressed before the staple feeder 20 comes into contact with the base 10, and so it is possible to prevent an excessive rotating motion of the lever 30. That is, the compression coil spring 43 acts as a stopper for the lever 30, thus allowing the front end of the staple feeder 20 to be free from coming into contact with the die 16 during such a punching operation. This allows the stapler to be free from any stapling operation during a punching operation, and so the stapler is completely prevented from unnecessarily consuming staples during such a punching operation. Such a stopper function provided by the compression coil spring 43 is due to the position of the lever shaft 32 placed within the lower holes of the second shaft holes 15. Of course, it should be understood that such a stopper function for the lever 30 may be accomplished by appropriately deforming another part in place of the spring 43. For example, it is possible to design the stapler in a way such that the lever 30 comes into contact with the top surface of the base 10 at the lower portion of its rear end when the lever 30 is fully pressed down.

When the pressing force is removed from the lever 30 after a punch operation, the punching plunger 40 elastically moves upwardly due to the restoring force of the compression coil spring 43. The lower edge 41 of the plunger 40 is removed from the punch hole 12 and is positioned above the slit 14, thus allowing the sheets of paper to be removed from the slit 14. As the plunger 40 elastically moves upwardly as described above, both the lever 30 and the staple feeder 20 are returned to their original positions. The stapler may be thus used again for punching new sheets of paper.

As described above, the stapler of the primary embodiment of this invention may be selectively used for a stapling operation with the lever shaft 32 being positioned within the upper holes of the second shaft holes 15, and may be selectively used for a punching operation with the lever shaft 32 being positioned within the lower holes of the second shaft holes 15. Such a displacement of the lever shaft 32 between the upper and lower holes of the shaft holes 15 is easily accomplished by appropriately moving the lever 30. When it is necessary to empty the cut piece container, the cover 50 is removed from the skirt 18 of the base 10.

The stapler with a punching unit according to the second embodiment of the invention will be described herein below in conjunction with FIGS. 6 and 7.

In the second embodiment, most of the elements are common with those of the primary embodiment. Those elements common to both the primary and second embodiments will thus carry the same reference numerals and further explanation is not deemed necessary. Different from the primary embodiment, the second shaft hole 15' of the stapler according to this second embodiment has a circular profile and the lever shaft 32' has a circular cross-section in the same manner as that of a conventional stapler. In addition, a stopper 13 is provided on the support walls 11 of the base 10 for limiting a rotating motion of the lever 30 during a punching operation within a predetermined angle.

In the present invention, it is possible to somewhat freely design the stopper 13. In the embodiment of FIG. 6, an arc-shaped slit **13*a* is formed on each of the two support walls 11, with a pin-shaped stopper 13 being movably set within the two slits 13*a* of the support walls 11 at both ends thereof. The above stopper 13 may be moved within the arc-shaped slits 13*a*** as will be described later herein.

The operational effect of the stapler according to the second embodiment will be described herein below.

When the stapler is used for a stapling operation, the stopper 13 has to be primarily moved to the lower ends of the two slits **13*a***.

In such a case, the lever 30 is biased upwardly by the spring-biased punching plunger 40, with the lower end of the plunger 40 being positioned above the sheet insert slit 14 in the same manner as that described for the primary embodiment.

Thereafter, the lever 30, with the staple feeder 20, is pressed down with sheets of paper being positioned on the die 16 of the base 10 in the same manner as a conventional stapler. When the lever 30 is pressed down as described above, the foremost staple contained in the staple feeder 20 is pushed into the sheets of paper by a pressing plate of the lever 30. In such a case, the punching plunger 40 is moved downwardly while compressing the coil spring 43, thus passing through the punch hole 12 of the base 10. However, such a vertical movement of the plunger 40 does not disturb the stapling operation. In addition, the stopper 13 is free from interfering with the lever 30 during the rotating motion of the lever 30.

When the pressing force is removed from the lever 30 after the stapling operation, the punching plunger 40 elastically pushes the lever 30 upwardly by the restoring force of the compression coil spring 43, thus returning both the lever 30 and the staple feeder 20 to their original positions.

When the stapler of this invention is used as a punch as shown in FIG. 7, the stopper 13 has to be primarily moved to the upper ends of the two slits 13*a*.

In such a case, the lever 30 is biased upwardly by the spring-biased punching plunger 40, with the lower end of the plunger 40 being positioned above the sheet insert slit 14 in the same manner as that described for the primary embodiment.

Thereafter, the lever 30, with the staple feeder 20, is fully pressed down with sheets of paper being inserted into the slit 14 of the support walls 11. When the lever 30 is pressed down as described above, the lower edge 41 of the punching plunger 40 is driven into the sheets of paper while compressing the coil spring 43 and passes through the punch hole 12 of the base 10, thus perforating the sheets of paper, with a plurality of cut pieces of paper being dropped into and collected within the container of the base 10 covered by the cover 50. During such a punching operation, the stopper 13 stops the downward rotating motion of the lever 30 and maintains the lever 30 at an inclined position relative to the base 10. It is thus possible to prevent an excessive rotating motion of the lever 30. That is, the stopper 13 allows the front end of the staple feeder 20 to be free from coming into contact with the die 16 during such a punching operation. This finally allows the stapler to be free from any stapling operation during a punching operation, and so the stapler is completely prevented from unnecessarily consuming staples during such a punching operation. When the pressing force is removed from the lever 30 after a punch operation, the punching plunger 40 elastically moves upwardly due to the restoring force of the compression coil spring 43. The lower edge 41 of the plunger 40 is removed from the punch hole 12 and is positioned above the slit 14, thus allowing the sheets of paper to be removed from the slit 14. As the plunger 40 elastically moves upwardly as described above, both the lever 30 and the staple feeder 20 are returned to their original positions. The stapler may be thus used again for punching new sheets of paper.

As described above, the stapler of the second embodiment of this invention may be selectively used for a stapling operation with the stopper 13 being positioned within the lower ends of the two slits 13*a*, and may be selectively used for a punching operation with the stopper 13 being positioned within the upper ends of the two slits 13*a*.

The stapler with a punching unit according to the third embodiment of the invention will be described herein below with reference to FIGS. 8 to 10.

In the third embodiment, the construction of the stapler is similar to that of the second embodiment. Those elements common to both the second and third embodiments will thus carry the same reference numerals and further explanation is not deemed necessary. Different from the second embodiment, the stapler according to the third embodiment is free from the stopper 13 or the arc-shaped slits 13*a* formed on the support walls 11, but has a longitudinal guide slit 35 formed on the rear portion of each sidewall of the lever 30, with a mode select pin 61 being transversely set within the guide slits 35 of the lever 30. The stapler of this third embodiment is selectively used for a stapling operation or a punching operation in accordance with a position of the mode select pin 61 within the guide slits 35.

As shown in FIG. 8, each guide slit 35 is longitudinally formed on the upper portion of each sidewall of the lever 30 at a position between the first shaft hole 31 and the bearing hole 33. The mode select pin 61 is movably set within the two guide slits 35 at its both ends, with one end of the pin 61 being tightened by a thumb-operable nut 62, and so the pin 61 is positioned above the punching plunger 40. In this embodiment, it is preferable to make the top end of the plunger 40 be flat, thus allowing the plunger 40 to come into stable contact with the mode select pin 61.

The stapler of this embodiment is effectively used while changing the operational mode of the stapler between a stapling mode and a punching mode by changing the position of the mode select pin 61 within the guide slits 35.

The operational effect of the stapler according to the third embodiment will be described herein below.

When the stapler is used for a stapling operation as shown in FIG. 9, the mode select pin 61 is primarily adjusted in a way such that the pin 61 is positioned within the ends of the guide slits 35 prior to being tightened by the nut 62 so as to be fixed at the adjusted position within the slits 35. When the lever 30 in the above state is pressed down, the stapler performs a desired stapling operation.

When the stapler is used for a punching operation as shown in FIG. 10, the mode select pin 61 is adjusted in a way such that the pin 61 is positioned at the middle position within the guide slits 35 prior to being tightened by the nut 62 so as to be fixed at the adjusted position. When the lever 30 in the above state is pressed down, the stapler performs a desired punching operation. That is, since the lever 30 pushes the top end of the punching plunger 40 downwardly when the lever 30 is pressed down as described above, the stapler performs the punching operation. When the lever 30 is fully pressed down, the top wall of the bracket 45 catches the top end portion of the plunger 40, and so the downward movement of the plunger 40 is limited within a desired range. In the above position, the pressing plate 34 of the lever 30 is stopped at a position where the plate 34 is placed just above the foremost staple contained in the feeder 20. The stapler is thus free from performing any stapling operation during a punching operation.

The stapler of this third embodiment is selectively used for a stapling operation or a punching operation in accordance with an adjusted position of the mode select pin 61 within the guide slits 35.

The stapler with a punching unit according to the fourth embodiment of the invention will be described herein below with reference to FIG. 11.

In the fourth embodiment, the general shape of the stapler remains the same as that described for the third embodiment, but the mode select means is altered. Those elements common to both the third and fourth embodiments will thus carry the same reference numerals and further explanation is not deemed necessary.

As shown in FIG. 11, the mode select means according to the fourth embodiment comprises a rectangular opening 36 formed at the rear end portion of the top wall of the lever 30. A fixing hole 37 is formed on each sidewall of the lever 30 at a position corresponding to the opening 36. A mode select pin 62, having a wheel 63 at its middle portion, is rotatably held by the two fixing holes 37 of the lever 30 at its both ends. In such a case, the wheel 63 of the pin 62 is received within the rectangular opening 35 of the lever 30 at its upper portion and is brought into movable contact with the top end of the punching plunger 40 at its lower portion. The mode select pin 62 is transversely movable on the lever 30, and so the wheel 63, integrated with the pin 62, is movable relative to the top end of the punching plunger 40. In this embodiment, it is preferable to make the top end of the plunger 40 be flat, thus allowing the plunger 40 to come into stable contact with the wheel 63 of the mode select pin 62.

The stapler of the fourth embodiment is effectively used while changing the operational mode between a stapling mode and a punching mode by changing the position of the wheel 63 relative to the punching plunger 40.

That is, when the stapler is used for a stapling operation, the mode select pin 62 is transversely moved to the right in FIG. 11, thus allowing the wheel 63 to be separated from the top end of the plunger 40 as shown by the phantom line of the drawing. When the lever 30 in the above state is pressed down, the stapler performs a desired stapling operation.

On the other hand, when it is necessary to use the stapler for a punching operation, the mode select pin 62 is transversely moved to the left in FIG. 11, thus allowing the wheel 63 to be positioned on the top end of the plunger 40 as shown by the solid line of the drawing. When the lever 30 in the above state is pressed down, the wheel 63 presses the top end of the plunger 40 downwardly, thus allowing the stapler to perform a desired punching operation. When the lever 30 is fully pressed down, the top wall of the bracket 45 catches the top end portion of the plunger 40, and so the downward movement of the plunger 40 is limited within a desired range. In the above position, the pressing plate 34 of the lever 30 is stopped at a position where the plate 34 is placed just above the foremost staple contained in the feeder 20. The stapler is thus free from performing any stapling operation during a punching operation.

As described above, the stapler of the fourth embodiment is selectively used for a stapling operation or a punching operation in accordance with an adjusted position of the wheel 63 of the mode select pin 61 relative to the top end of the punching plunger 40.

Figure 12:
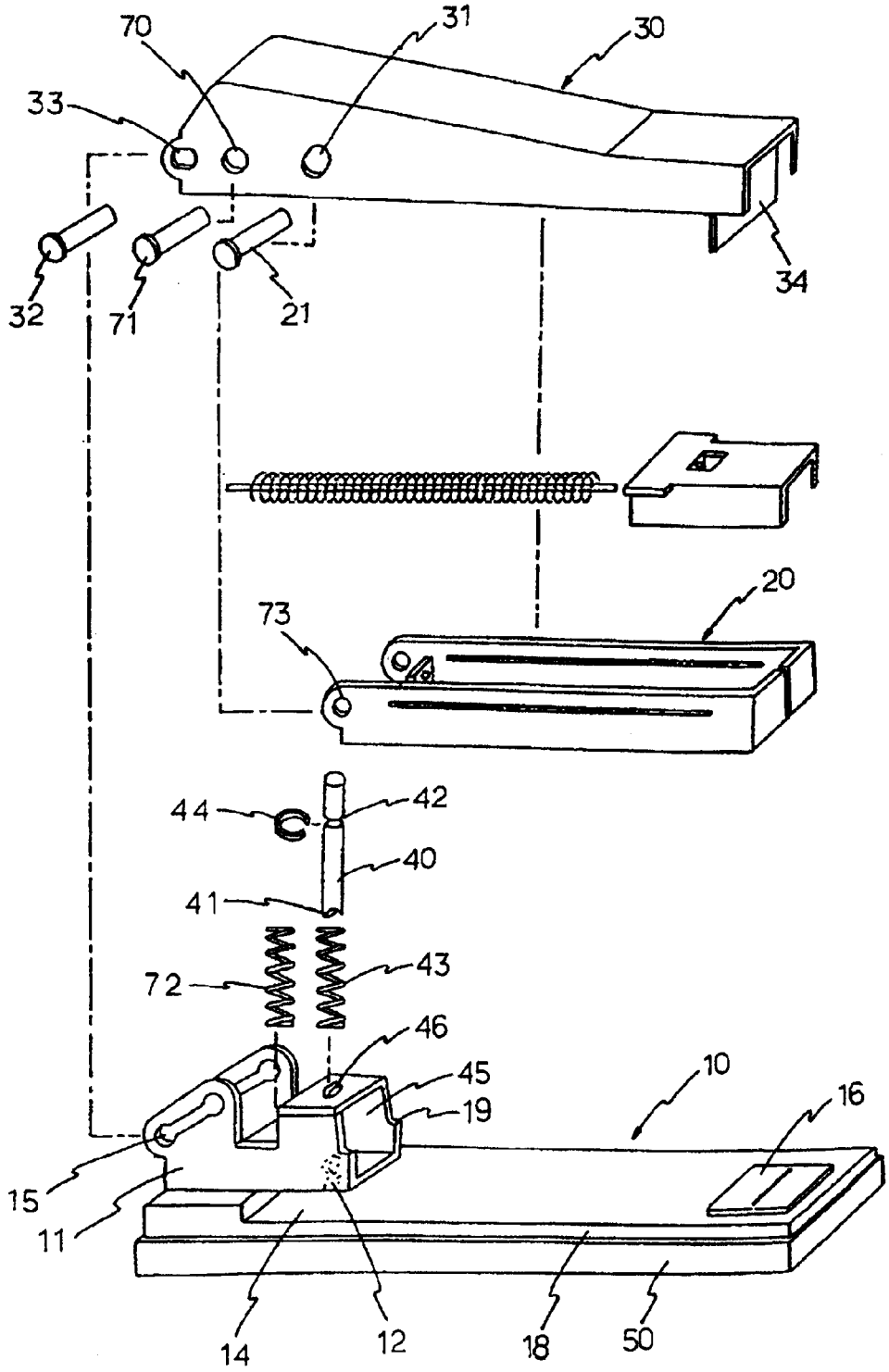
Figure 13:
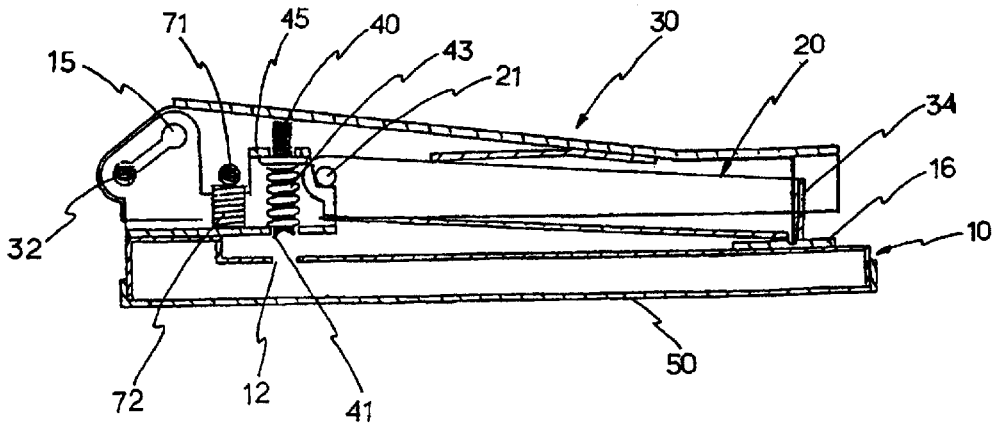
Figure 14:
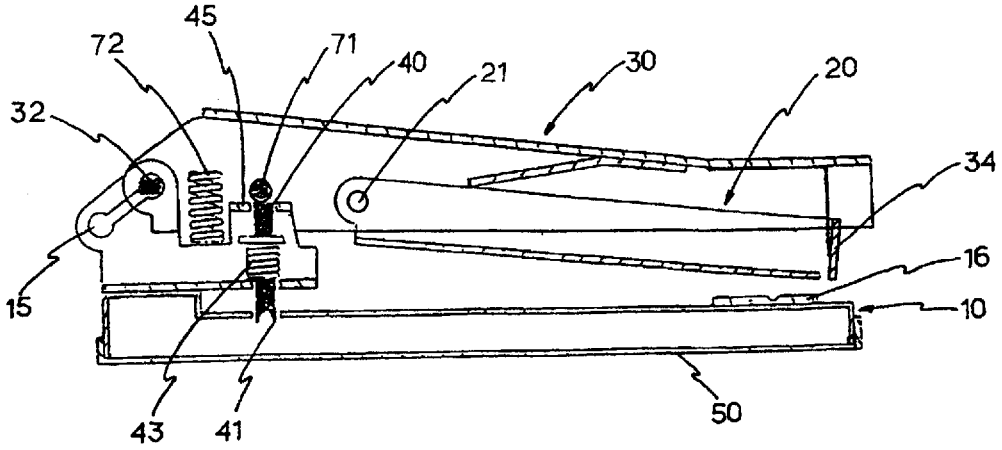

FIGS. 12 to 14 show a stapler with a punching unit according to the fifth embodiment of the invention.

As shown in the drawings, the general shape of the stapler according to the fifth embodiment remains the same as that described for the primary embodiment, but some elements are altered as will be described later herein. Those elements common to both the primary and fifth embodiments will thus carry the same reference numerals and further explanation is not deemed necessary. Different from the primary embodiment, the stapler according to the fifth embodiment has a third shaft hole 70 on each sidewall of the lever 30 at a position between the first shaft hole 31 and the bearing hole 33, with a pressure pin 71 being held by the two third shaft holes 70 at its both ends. In addition, the bracket 45 is integrated with the front end portions of the two support walls 11, while a coil spring 72 is vertically positioned between the bracket 45 and the pressure pin 71. Therefore, the lever 30 is rotatable around the pressure pin 71.

In addition, different from the stapler of the primary embodiment designed to be used for a stapling operation with the lever shaft 32 being positioned within the upper holes of the second shaft holes 15 and for a punching operation with the shaft 32 being positioned within the lower holes of the shaft holes 15, the stapler of the fifth embodiment is designed to be used for a stapling operation with the shaft 32 being positioned within the lower holes of the second shaft holes 15 and for a punching operation with the shaft 32 being positioned within the upper holes of the shaft holes 15. In a brief description, the position of the lever shaft 32 within the second shaft holes 15 for performing a desired stapling or punching operation is opposed to that in the case of the primary embodiment.

The operational effect of the stapler according to the fifth embodiment will be described herein below.

When the stapler is used as a conventional stapler as shown in FIG. 13, the pressing lever 30 has to be primarily moved so as to make the lever shaft 32 positioned within the lower holes of the second shaft holes 15. In such a case, the lever 30 is biased upwardly by the spring-biased pressure pin 71, while the punching plunger 40 is biased upwardly by the coil spring 43 with the lower end of the plunger 40 being positioned above the sheet insert slit 14.

Thereafter, the lever 30, with the staple feeder 20, is pressed down with sheets of paper being positioned on the die 16 of the base 10 in the same manner as a conventional stapler. When the lever 30 is pressed down as described above, the two locking flanges 19 catch the lower ends of the rear portion of the staple feeder 20, with the front end of the feeder 20 being close to the staple die 16 just before both sharpened ends of a staple are pushed into the sheets of paper. In such a case, the front end of the feeder 20 is precisely positioned above the die 16.

When the lever 30 in the above state is further pressed down, the foremost staple contained in the staple feeder 20 is pushed into the sheets of paper by the pressing plate 34 of the lever 30. When the staple is pushed into the sheets of paper, the staple feeder 20, caught by the locking flanges 19, is prevented from being further rotated downwardly. In such a case, the projected length of the staple feeder 20 is increased as the lever 30 is pressed down to push the ends of the staple into the sheets of paper. However, the feeder shaft 21 moves backwardly along the arc-shaped first shaft holes 31 while absorbing the increased projected length of the feeder 20, thus allowing the stapling position to be precisely maintained.

Since the pressure pin 71 in such a stapling operation is separated from the top end of the punching plunger 40, the plunger 40 is not moved downwardly even when the lever 30 is pressed down. Therefore, the punching plunger 40 does not disturb the stapling operation. When the pressing force is removed from the lever 30 after the stapling operation, the lever 30 is elastically pushed upwardly by the restoring force of the coil spring 72, and so both the lever 30 and the staple feeder 20 are returned to their original positions.

When the stapler of the fifth embodiment is used as a punch as shown in FIG. 14, the pressing lever 30 has to be moved so as to make the lever shaft 32 positioned within the upper holes of the second shaft holes 15. In such a case, the lever 30 is biased upwardly by the spring-biased punching plunger 40, with the lower end of the plunger 40 being positioned above the sheet insert slit 14.

Thereafter, the lever 30, with the staple feeder 20, is fully pressed down with sheets of paper being inserted into the slit 14 formed at the front or rear portion of the support walls 11. When the lever 30 is pressed down as described above; the lower edge 41 of the punching plunger 40 is driven into the sheets of paper while compressing the coil spring 43 and passes through the punch hole 12 of the base 10, thus perforating the sheets of paper. Such a punching operation forms a plurality of cut pieces of paper, which are dropped into and collected within the container of the base 10 covered by the cover 50. During such a punching operation, the coil spring 43 is compressed as the lever 30 is pressed down. In such a case, the spring 43 is completely compressed before the staple feeder 20 comes into contact with the base 10, and so it is possible to prevent an excessive rotating motion of the lever 30. Such a stopper function provided by the compression coil spring 43 is due to the position of the lever shaft 32 placed within the upper holes of the second shaft holes 15.

As described above, the stapler of the fifth embodiment of this invention may be selectively used for a stapling operation with the lever shaft 32 being positioned within the lower holes of the second shaft holes 15, and may be selectively used for a punching operation with the lever shaft 32 being positioned within the upper holes of the second shaft holes 15. Such a displacement of the lever shaft 32 between the upper and lower holes of the shaft holes 15 is easily accomplished by appropriately moving the lever 30.

Figure 15:
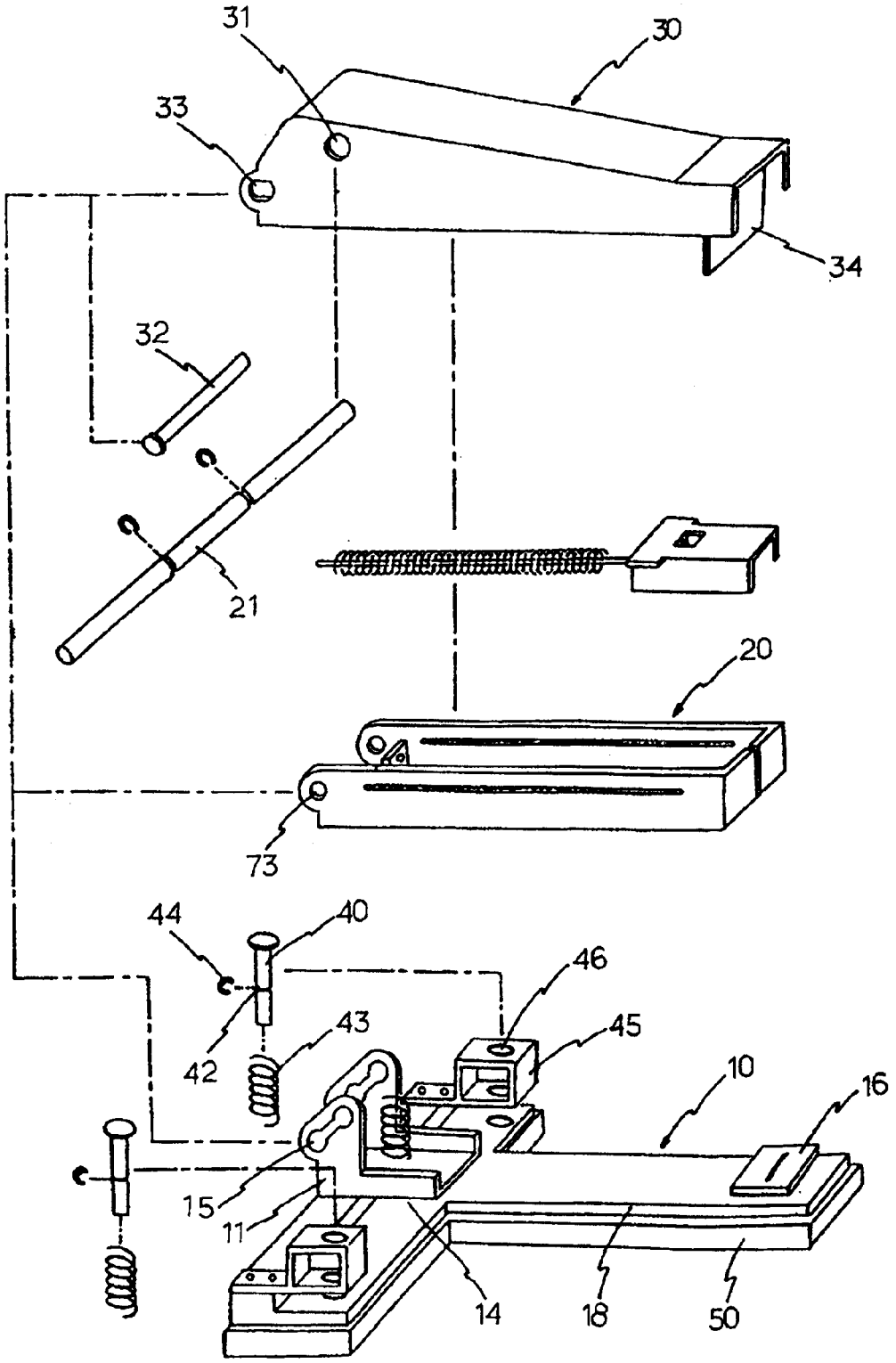
Figure 16:
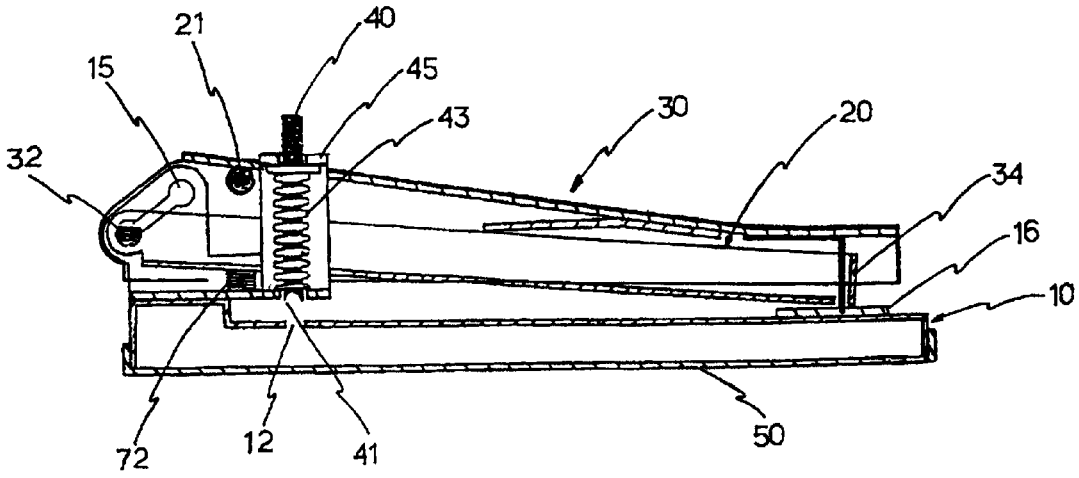
Figure 17:
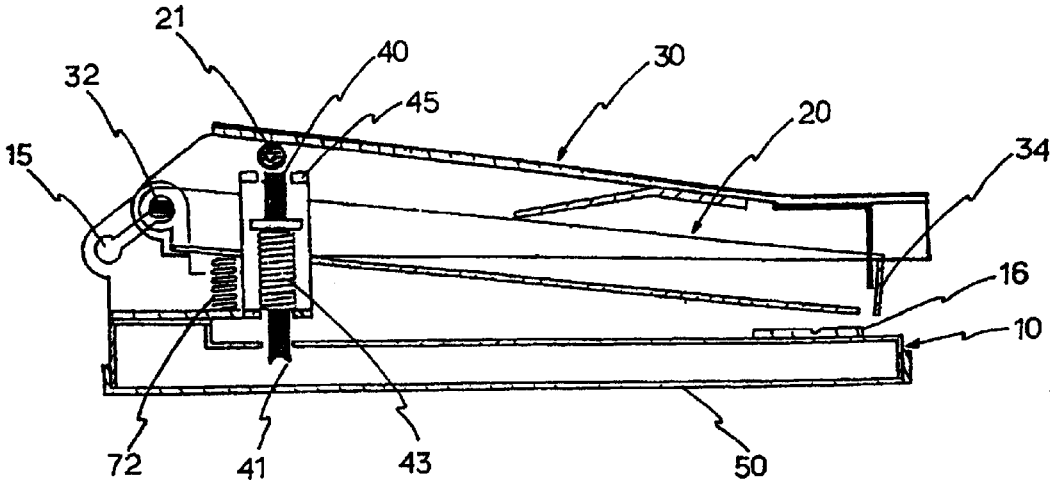

FIGS. 15 to 17 show a stapler with a punching unit according to the sixth embodiment of the invention.

As shown in the drawings, in the stapler according to the sixth embodiment, the rear end portion of the base 10 is formed to have a T-shaped profile different from the stapler of the fifth embodiment. That is, the rear end portion of the base 10 has two lateral extensions, with two brackets 45 being seated on the extensions of the base 10 at positions outside the two support walls 11. Two punch holes 12 are formed on the two extensions of the base 10. The pressure pin 21, held by the two shaft holes 31, is increased in length so as to reach the positions above the plunger holes 46 of the two brackets 45.

In the sixth embodiment, the staple feeder 20 directly engages with the oval lever shaft holes 33 of the lever 30 at the holes 73, and so the stapler of this embodiment is free from the locking flanges 19.

In addition, the coil spring 72 is vertically positioned to meet the lower surface of the staple feeder 20 at its top end different from the stapler of the fifth embodiment of which the spring 72 meets the pressure pin 71. Therefore, the pressure pin 71 is always positioned above the feeder 20 and is selectively biased by the coil spring 43 only when the stapler is used for a punching operation.

The operational effect of the stapler according to the sixth embodiment will be described herein below.

When the stapler is used as a conventional stapler as shown in FIG. 16, the pressing lever 30 has to be primarily moved so as to make the lever shaft 32 positioned within the lower holes of the shaft holes 15. On the other hand, when the stapler of the fifth embodiment is used as a punch as shown in FIG. 17, the pressing lever 30 has to be moved so as to make the lever shaft 32 positioned within the upper holes of the shaft holes 15.

Industrial Applicability

As described above, the present invention provides a stapler with a punching function. The stapler of this invention is designed to have a collateral punching function in addition to an original stapling function, and so the stapler is selectively used as a stapler or a punch as desired. The stapler of this invention allows a user to purchase a punch-integrated stapler without forcing excessive costs on the user and is convenient to the user while keeping and using it. Since the stapler has a simple construction, the stapler is manufactured at a low production cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A stapler with a punching unit, comprising:

a longitudinal base having a staple forming die at its front end portion and two parallel support walls at its rear end portion, with both a punch hole being formed on a top surface of the base at a position between the two support walls and a sheet insert slit being formed between the two support walls and the top surface of the base so as to allow of paper to be inserted into the slit during a punching operation;

a pressing lever hinged to first shaft holes of the support walls at its bearing holes using a lever shaft and manually operated by a user so as to perform a desired stapling operation or a desired punching operation;

a staple feeder hinged to second shaft holes of said pressing lever and used for receiving staples therein; and a punching plunger having a cutting edge at its lower end, said punching plunger being vertically positioned on said base at a position between the two support walls while being normally biased by a spring upwardly, thus coming into contact with the lower surface of said pressing lever at its top end and being vertically inserted into said punch hole at its lower end portion, wherein a rectangular opening is formed at the rear end portion of the top wall of said pressing lever, while a fixing hole is formed on each sidewall of said pressing lever at a position corresponding to said rectangular opening, with a mode select pin having a wheel at its middle portion and being movably held by the two fixing holes of said pressing lever at its both ends in a way such that the wheel of the mode select pin is received within the rectangular opening of said pressing lever at its upper portion and is brought into movable contact with the top end of said punching plunger at its lower portion, thus allowing the stapler to be selectively used for a stapling operation or a punching operation in accordance with a position of the wheel relative to the top end of the punching plunger.

2. The stapler according to claim 1, wherein the lever shaft has an oval cross-section, and the bearing holes of said pressing lever have an oval-shaped profile corresponding to the cross-section of the lever shaft, and each of the first shaft holes of the support walls comprises two oval holes, the two oval holes of each shaft hole being formed at different positions with different heights and communicating with each other through a channel.

3. The stapler according to claim 1, wherein the lever shaft has a circular cross-section, and each of the first shaft holes of the support walls has a circular profile corresponding to the cross-section of the lever shaft, with an arc-shaped slit being formed on each of the two support walls and a pin-shaped stopper being movably set within the two arc-shaped slits of the support walls at both ends thereof, said stopper being used for limiting a rotating motion of said pressing lever during a punching operation with a predetermined angle.

4. The stapler according to claim 1, wherein a longitudinal guide slit is formed on the rear portion of each sidewall of said lever, with a mode select pin being transversely set within the guide slits of the lever, and so the stapler is selectively used for a stapling operation or a punching operation in accordance with a position of the mode select pin within the guide slits.

5. The stapler according to claim 1, wherein a third shaft hole is formed on each sidewall of said pressing lever at a position between the second shaft hole and the bearing hole, a pressure pin is held by the two third shaft holes of said pressing lever at its both ends, a bracket is integrated with the front end portions of the two support walls, and a coil spring is vertically positioned between the bracket and the pressure pin, thus allowing said pressing lever to be rotatable around the pressure pin.

6. The stapler according to claim 1, wherein the rear end portion of said base is formed to have a T-shaped profile with two extensions, two brackets are seated on the two extensions of the base at positions outside the two support walls, two punch holes are formed on the two extensions of the base, and a pressure pin, having an increased length capable of reaching the positions above plunger holes of the two brackets, is held by the first shaft holes of the lever, thus perforating sheets of paper at two positions at the same time during a punching operation.

* * * * *